United States Patent [19]

Merser et al.

[11] 3,979,799

[45] Sept. 14, 1976

[54] INTERLOCKING ATTACHMENT DEVICE

[75] Inventors: Francis G. Merser, Framingham Center; Philip A. Kooistra, Northbridge; Gordon B. Lankton, West Bolyston, all of Mass.

[73] Assignee: Dennison Manufacturing Company, Framingham, Mass.

[22] Filed: Jan. 20, 1975

[21] Appl. No.: 542,620

Related U.S. Application Data

[63] Continuation of Ser. No. 467,917, May 8, 1974, abandoned.

[52] U.S. Cl. ..... 24/159 FP; 292/322

[51] Int. Cl.[2] ..... A44B 9/00; B65D 55/06

[58] Field of Search..... 24/150 FP, 16 PB, 73 PF, 24/30.5 P, 206 A, 208 A; 292/307 R, 317, 321, 322

[56] References Cited

UNITED STATES PATENTS

| | | | |
|---|---|---|---|
| 1,558,960 | 10/1925 | Brune | 292/322 |
| 3,103,666 | 9/1963 | Bone | 24/150 FP UX |
| 3,147,522 | 9/1964 | Schumm | 24/165 PB |
| 3,466,077 | 9/1969 | Moberg | 292/322 |
| 3,600,027 | 8/1971 | Noland et al. | 292/322 |
| 3,753,586 | 8/1973 | Patterson | 292/322 |
| 3,757,389 | 9/1973 | Wiland | 24/150 R |

FOREIGN PATENTS OR APPLICATIONS

| | | | |
|---|---|---|---|
| 268,500 | 10/1963 | Australia | 24/208 A |

*Primary Examiner*—Donald A. Griffin
*Attorney, Agent, or Firm*—George E. Kersey

[57] ABSTRACT

An attachment device comprises a filament having a normally laterally oriented bar at one end and a unitary hollow body member at its other end. The body member has a sidewall, an apertured end wall, a heat sealed end wall opposed thereto and a flange which projects outwardly from the sidewall and functions as a heat sink to permit heat sealing of the end wall without heat deformation of the apertured end wall and the portion of the sidewall adjacent thereto. The aperture in the end wall is large enough to receive the filament and the bar when they are in parallel orientation, but of a width smaller than the length of the bar so as to prevent the withdrawal of the bar from the hollow interior subsequent to insertion. An assembly of attachment devices suitable for use with an attaching mechanism comprises a plurality of such attachment devices and securing means interposed between and connected to the flanges to secure adjacent body members together.

18 Claims, 6 Drawing Figures

INTERLOCKING ATTACHMENT DEVICE

This is a continuation of Ser. No. 467,917 filed May 8, 1974 and now abandoned.

BACKGROUND OF THE INVENTION

Devices for attaching two objects together, such as are widely used to fasten tags or labels to garments and the like, are disclosed in Bone U.S. Pat. No. 3,444,597 (issued May 20, 1969) and Kirk U.S. Pat. No. 3,380,122 (issued Apr. 30, 1968), both patents being owned by the assignee of the instant application. Such prior art attaching devices or attachments generally comprise an elongated filament-like member having an object-penetrating part at one end thereof, and a part at the other end thereof which is enlarged relative to the thickness or diameter of the elongated member. The object-penetrating part is designed to be passed through a hole (whether pre-existing or made as part of the attaching operation) in the object. The object-penetrating part has a normal axial orientation substantially lateral or transverse to the axis of the elongated member to form a T-shaped configuration therewith, but is resiliently deformable relative to the elongated member so that the axes may be temporarily aligned. The thus aligned object-penetrating part and elongated member are capable of passing end-wise through the aligned hole of the objects with which it is to be associated, but upon release of the deforming force they resume their normal T-shaped configuration. Accordingly, after attachment the object-penetrating part is disposed on the far side of the object, the elongated member passes through the holes, and the enlarged part remains on the near side of the objects; thus escape of the attachment from the objects in question in one direction is precluded by the laterally-extending object-penetrating part, and in the other direction by the enlarged part.

As disclosed in the cited patents, the attachments are generally provided in the form of an assembly or "clip" of a plurality of such attachments — a typical clip includes 20 attachments. An attaching mechanism or "gun" of the type disclosed in Bone U.S. Pat. No. 3,103,666 (issued Sept. 16, 1963 and owned by the assignee of this application) may be employed to form the hole through the object with which the attachment is to be associated (or the holes through the objects to be fastened together), sever a single attachment from the assembly of attachments, and force the object-penetrating part of the attachment through the hole(s) to the far side. The attachment in question, particularly when used in connection with such an attaching "gun", may be applied quite rapidly even by relatively unskilled personnel, thus greatly reducing the cost of tagging, labeling and securing objects to one another in general.

The aforementioned attachments have become extremely widely used in industry for the attachment of tags and labels to articles to be sold on the retail market as the attachments are particularly effective in preventing unscrupulous shoppers from switching tags — that is, removing a tag from a low-priced article, attaching it to a higher-priced article, and then paying only the lower price for the higher-priced article. Nevertheless, the fact that both ends of the attachment are exposed raises the possibility that a new scheme might be devised for switching tags from a low-priced to a higher priced article. For example, an unscrupulous shopper given sufficient time might be able to align the normally transverse axes of the elongated member and the object-penetrating part, then thread the two back through the holes of the object and tag, and thereafter make any desired substitution. Accordingly, an attaching device of the type described in Francis G. Merser et al. U.S. Pat. application Ser. No. 467,918 entitled "Interlocking Attachment Device" (filed concurrently herewith and owned by the assignee of the instant application) was devised to provide a self-contained attachment wherein the parts at the ends of the elongated member were interlocked during attachment. In such an attachment the enlarged part is formed with a hollow interior adapted to receive and retain the object-penetrating part; more particularly, the hollow enlarged part is formed with a sidewall defining a hollow interior, an end wall having an aperture therethrough leading into the hollow interior and an imperforate end wall opposed to the apertured end wall and connected thereto by the sidewall. In this manner, once the object-penetrating part was inserted into the hollow interior the only way the attachment could be removed from an object would be by actual breaking of the elongated member, thereby preventing its subsequent use and providing a clear indication of tampering. An additional advantage of such a self-contained, interlocking attachment is that it simultaneously functions as means for hanging articles for display.

While the self-contained, interlocking attachment has been found to perform successfully, manufacture of the attachment has so far required the molding of at least two distinct pieces — the elongated member, the object-penetrating part and the sidewall and apertured end wall portions of the hollow enlarged part as a first piece, and the imperforate end wall of the hollow enlarged part as a second piece — and the subsequent joining of the two pieces by adhesive techniques. Construction of the various parts of the attachment, and in particular the hollow enlarged part, in situ is precluded by the well recognized limitations of the molding art as regards the formation of hollow tubular parts with specific interior and exterior configurations and two end walls providing but a single aperture of limited diameter leading into the interior; at best the two pieces could be formed in a single molding operation with a flexible hinge or connecting member therebetween to prevent loss of either piece during handling by the manufacturer. Attempts at a one piece construction of the attachment, involving the molding only of the first piece and heat sealing of the exposed edges of the sidewall of the hollow enlarged part to form in situ an imperforate end wall, were not entirely satisfactory for the same reason that heat sealing of the second piece (i.e., the distinct imperforate end wall) onto the first piece was not a recommended manufacturing technique. Despite the simplicity and economy of a heat sealing operation (whether of a single or two piece construction), various problems which precluded commercial utilization of heat sealing in the manufacture of attachments were encountered. The heat produced at the seal area during the operation affected through heat conduction other areas of the hollow enlarged part. More particulaly the thermoplastic material defining the aperture of the apertured end wall and the hollow interior formed by the sidewall could deform to such a degree that portions of the deformed material would block passage of the object-penetrating part through the apertures and/or into the hollow interior.

Heat deformation of the exterior surface of the sidewall not only resulted in an aesthetically unappealing appearance for the hollow enlarged part, but also tended to weaken the connection of the elongated member to the sidewall exterior surface.

Accordingly, it is an object of the present invention to provide a self-contained, interlocking attachment wherein the object-penetrating part is secured within a unitary hollow enlarged part to preclude tampering therewith; the hollow enlarged part being unitarily formed of thermoplastic material in a single molding operation and completed by heat sealing of one end of the part.

It is another object to provide such an attachment in which one end of the hollow enlarged part is formed by heat sealing without deleteriously affecting to any appreciable degree the remainder of the part.

An object of the present invention is to provide a self-contained, interlocking attachment which can be maufactured by means of simple, inexpensive molding nd heat-sealing operations.

SUMMARY OF THE INVENTION

It has now been found tht the foregoing and related objects can be readily obtained in an attachment device comprising a filament, a unitary hollow body member connected to the filament adjacent one end thereof, and a normally at least partially laterally oriented bar resiliently connected to the tilament adjacent the other end thereof. The body member comprises a sidewall defining a hollow interior for the body member, an end wall having an aperture therethrough leading into the hollow interior, a heat-sealed end wall opposed to the apertured end wall and connected thereto by the sidewall, and a flange projecting outwardly from the sidewall. The hollow interior has a greater width than the aperture, and the flange is configured and dimensioned to dispose an appreciable fraction of its mass and exposed surface substantially outwardly of the sidewall, thereby to function as a heat sink and to permit heat-sealing of the end wall without heat deformation of the apertured end wall and the portion of the sidewall adjacent thereto. The bar has a length greater than the maximum width of the aperture and a thickness such that when the bar is oriented in a direction generally parallel to the filament, the bar and the filament are passable axially through the aperture and receivable in the hollow interior; but when the bar is oriented in a different direction within the hollow interior, the bar is engageable by the apertured end wall to mantain the bar within the hollow interior.

The filament, the bar and the body member comprise a unitary piece of thermoplastic material, preferably nylon, with the filament being connected to the heat sink flange of the body member and with the filament being resiliently connected to the bar so as to permit temporary parallel alignment of their axes under pressure.

In a preferred embodiment, the heat sink flange extends over an entire peripheral section of the sidewall and is closer to the sealed end wall than to the apertured end wall. Furthermore, the flange projects outwardly from the sidewall to substantially varying heights and connects the filament to the body member.

An assembly of a plurality of the aforementioned attachment devices further includes securing means interposed between and connected to the flanges to secure the body members together.

Optionally, the plurality of projections extending into the opening may be provided in order to aid in stripping the bar from the insertion mechanism and thereafter to further facilitate retention of the bar in the hollow body member.

DETAILED DESCRIPTION OF THE ILLUSTRATED EMBODIMENT

Figures 1, 2:
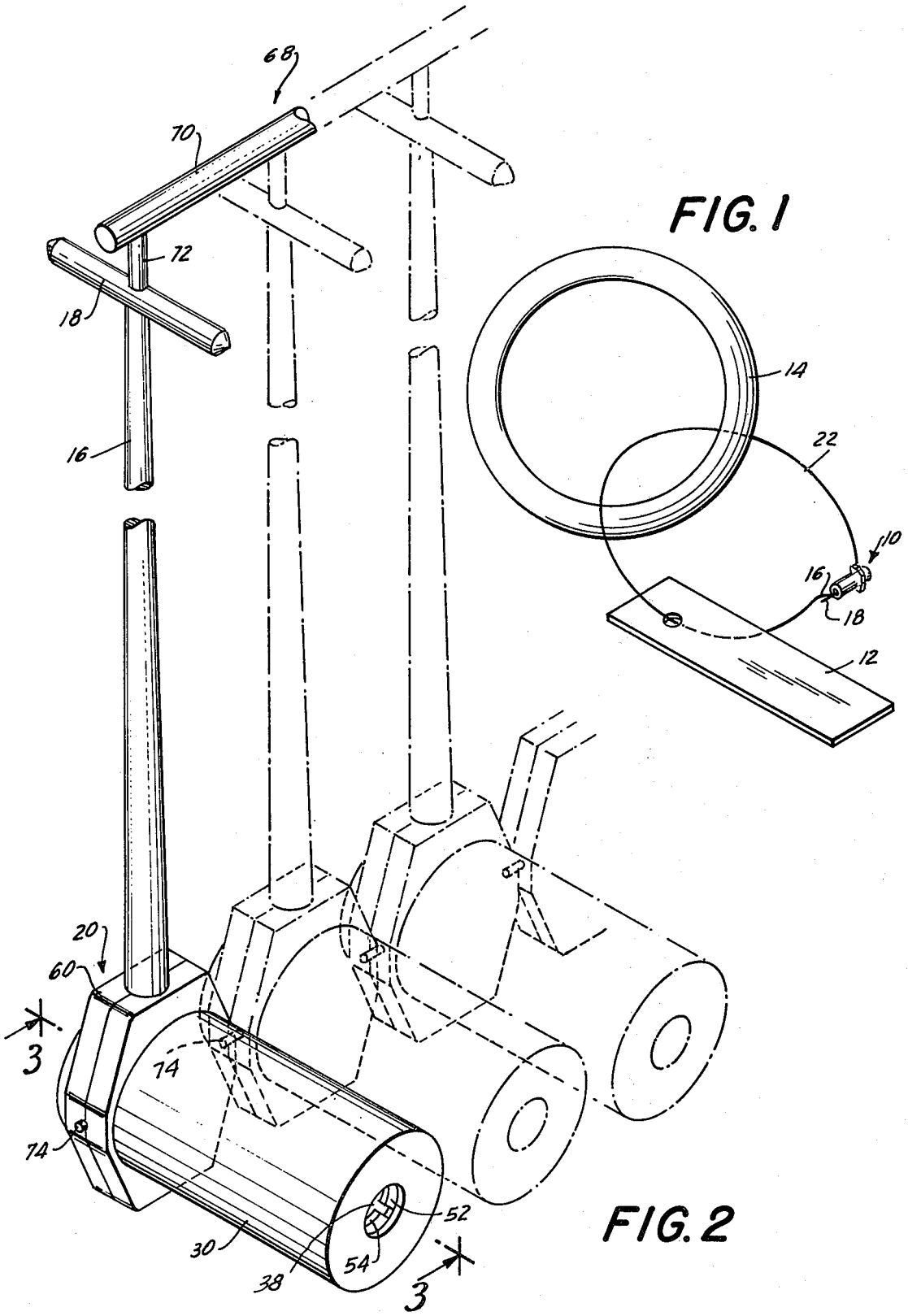
FIG. 1 is a perspective view showing the attachment of the present invention with its ends being joined so as to secure a tag to an object.
FIG. 2 is a perspective view of the attachment assembly of this invention showing the component parts of the individual attachments thereof.

Referring now to the drawing, and in particular to FIG. 1 thereof, an attaching device generally designated by the number 10 secures a tag 12 to an article of merchandise 14. In the specific embodiment depicted in FIGS. 2–6, the attachment 10 comprises an elongated filament 16, a normally at least partially laterally oriented bar 18 at one end thereof and a unitary hollow body member generally designated by the numeral 20 at the other end thereof. In operation, as will be described in more detail hereinafter, the crossbar 18 is inserted axially through a tag 12 and an object 14 and into body member 20, the interlocked retention of crossbar 18 in body member 20 thereby forming filament loop 22 passing through tag 12 and object 14 to operatively connect them.

Crossbar 18 is a relatively thin cylinder resiliently connected at its midpoint to filament 16 and extending generally at right angles to the filament 16 to form therewith a generally T-shaped configuration. The crossbar 18 is shown as having a circular cross-section but various other shapes may be suitable. Unless the article of merchandise 14 is provided with a pre-existing hole of adequate size, it is preferred that 18 have a sufficiently small effective cross-section to allow it to be threaded through the object 14 without producing a noticeable hole therein.

Body member 20, which is situated at the end of filament 16 opposite to crossbar 18, has an axially extending integral sidewall 30 defining a hollow interior 32, a sealed end wall 34 (which will be described in detail hereinafter) and an opposite end wall 36 defining an aperture 38 therethrough leading into hollow interior 32. Hollow interior 32 has a greater maximum width than aperture 38, thereby permitting the remainder of the apertured end wall 36 to function as an abutment 40 between the hollow interior 32 and the aperture 38. While the configurations of body member 20, hollow interior 32 and aperture 38 are shown as substantially circular, they may vary from circular and from one another in accordance with the practitioner's requirements.

The dimensional relationships between the filament 16, the crossbar 18, and the hollow body member 20 are critical. The aperture 38 must be large enough to permit pasage therethrough, and into the hollow interior 32, of the crossbar 18 and the immediately adjacent length of the filament 16 when the crossbar 18 and filament 16 are deformed to an orientation wherein their axes are substantially parallel to each other and perpendicular to the plane of the aperture 38. On the other hand, the length of the crossbar 18 must be greater than the maximum width of aperture 38 to prevent separation of the interlocked parts by withdrawal of the crossbar 18 through the aperture 38 after relaxation of the deforming force. The thicknesses of the crossbar 18 and filament 16 must be such that when the crossbar 18 is oriented in a direction generally parallel to the immediately adjacent length of the filament 16, the two are passable axially through the aperture 38 and receivable in the hollow interior 32; and when the crossbar 18 within the hollow interior 32 is oriented in a direction other than essentilly parallel to the axis of the aperture 38, the crossbar 18 is engageable by the apertured end wall 36 to maintain it therein. (The former orientation is the result of mechanical or manual force applied to deform the normal configuration, while the latter orientation is the result of the natural tendency of the filament 16 and crossbar 18 to return to a T-configuration, aided by the action of the projections 50, 52, 54 which will be described in detail hereinafter.)

Figure 4:
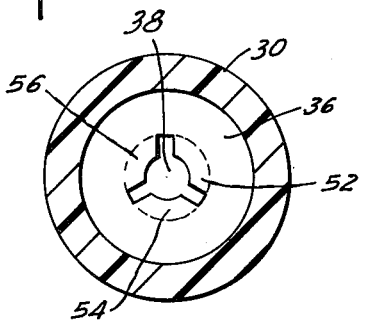
FIG. 4 is a cross-sectional view taken along line 4—4 of FIG. 3 showing one embodiment of a bar-retaining projection.

The body member 20 further includes a flange 60 disposed on and projecting ouwardly from the sidewall 30 and forming the connection between filament 16 and the sidewall 30. Referring now in particular to FIG. 4, the outward configuration of the flange 60 resembles an elongated and slightly oval rectangle, the elongated flange ends extending outwardly from sidewall 30 substantially further than the flange sides. The flange 60, of course, extends outwardly from the exterior surface of the sidewall 30 to conduct heat away from the sidewall 30 and maintain the length of sidewall 30 beyond the flange below deforming temperatures. The flange 60 is disposed on the sidewall 30 closer to the sealed end wall 34 than to the apertured end wall 36 so that protection is afforded during heat sealing to the portion of the body member 20 between the flange 60 and the apertured end wall 36 which will receive and engage the crossbar 18. To provide complete protection with a single flange, the flange 60 extends completely around a peripheral section of the body member sidewall 30; i.e., about a circumferential slice of the circular sidewall 30. The degree or level to which portions of the flange 60 project outwardly from the sidewall 30 varies, not only with the location of the portion of the flange along the periphery of the circumferential slice, but also with the location of the portion of the flange along the axis of the sidewall 30.

It is essential that the flange 60 be configured and dimensioned to dispose an appreciable fraction of its mass and exposed surface area substantially outwardly of the sidewall 30 in order to function effectively as a heat sink. The mass interposed betwen the heat source and the vital portions of the body member 20 adapted to receive the crossbar 18 serves to absorb and distribute the heat, while the exposed surface area permits rapid dissipation from the flange 60 of the absorbed and distributed heat. Such a flange 60 permits heat sealing of the end wall 34 without accompanying heat deformation of the apertured end wall 36 and the portion of the sidewall 30 adjacent thereto which receives the cossbar 18. In the absence of such a heat sink during the heat sealing operation, the opposite end wall 36 defining the aperture 38 and/or the segment of the sidewall 30 adjacent thereto defining the front section of hollow interior 32 may deform to such a degree as to interfere subsequently with the free reception of the crossbar 18 through aperture 38 and into hollow interior 32. Another disadvantage of heat sealing in the absence of such a heat sink is that a direct physical connection of the body member 20 and the filament 16 may be weakened to such a degree as to result in accidental separation thereof or facilitate intentional breakage of the connection to enable the removal of tags. Yet another disadvantage of heat sealing in the absence of such a heat snk is that the exterior surface of sidewall 30 deforms to present an unsightly appearance.

Obviously any particular combination of shape, length, thickness, mass and the like may be selected for configurations and dimensions of the flange 60, whether based on aesthetic or practical considerations, as long as the flange is configured and dimensioned to operate as an effective heat sink; that is, an integrally formed heat sink which essentially precludes harmful deformation of the body member 20 and the filament 16 during the heat treatment effecting closure of the end wall 34 of the body member 20. As the presence of flange 60 permits heat sealing, it simplifies manufacturing procedures and reduces manufacturing cost as the entire attachment 10 comprising filament 16, crossbar 18, and body member 20 may thus be unitarily formed in a single molding operation and finished with a single heat sealing operation.

Figure 6:
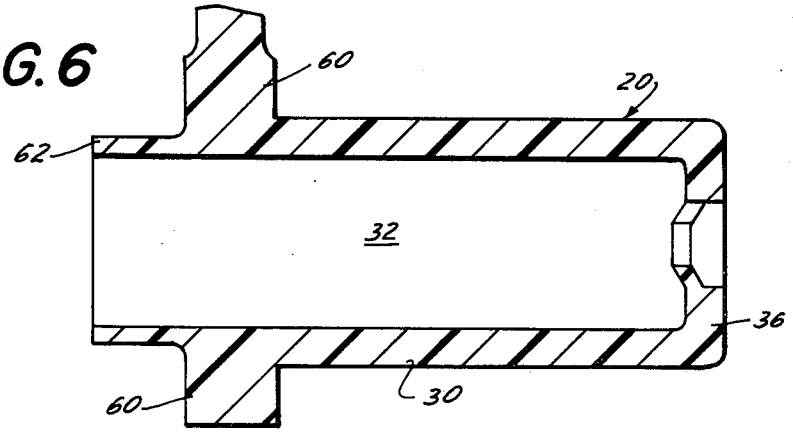
FIG. 6 is a cross-section view of the body member shown in FIG. 2 prior to heat sealing.

Referring now to FIG. 6, prior to heat sealing, the body member 20 fr0med by the molding operation has an extension 62 of sidewall 30 rather than a sealed end wall 34. The sidewall extension 62 or similar flap is subsequently heat-sealed to provide a closed end wall 34 for the body member 20 proximate to the flange 60 as shown in FIG. 12. As part of the conventional heat sealing operation, mechanical means may be used to urge the molten thermoplastic material towards the desired areas or permit use of lower heat sealing temperatures.

Figure 3:
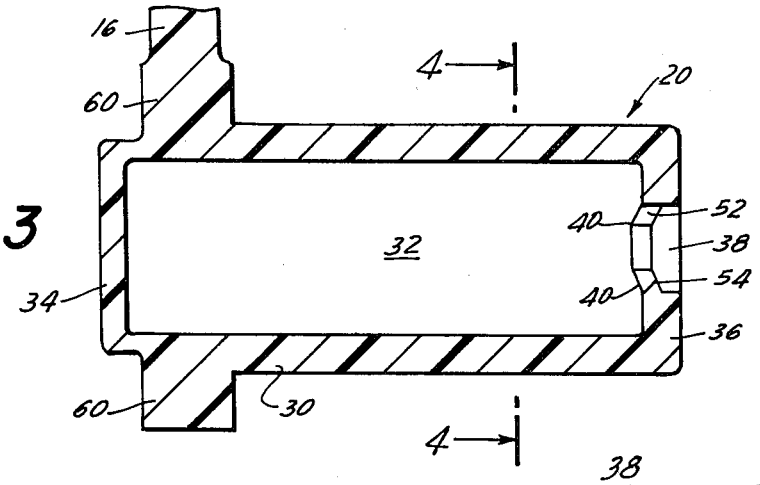
FIG. 3 is a cross-sectional view taken along line 3—3 of FIG. 2 depicting an embodiment of a hollow body member.
Figure 5:
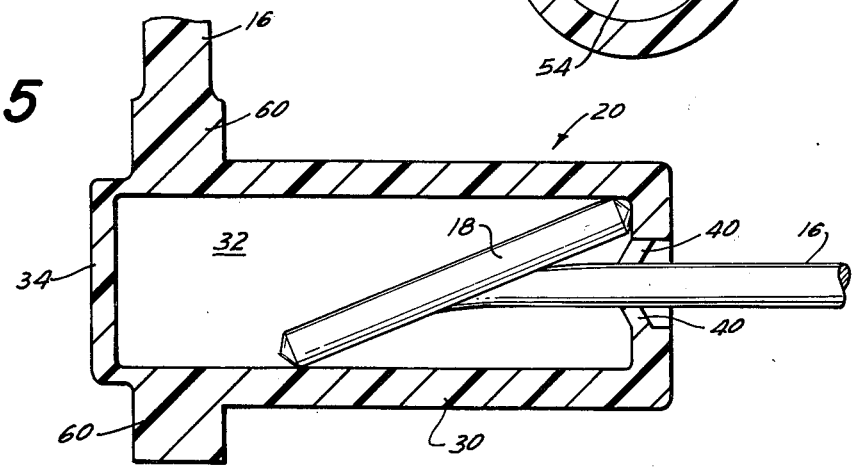
FIG. 5 is a cross-sectional view of the body member of FIG. 3 depicting the retention of the crossbar therein.

Referring now to FIGS. 3 and 4, a plurality of resilient projections 50, 52, 54 extend generally laterally into the aperture 38 from the end wall 36 defining the aperture 38. The projections 50, 52, 54 facilitate ejection of crossbar 18 and filament 16 from the penetrating needle of an attaching "gun" into the hollow interior 32 and thereafter aid in the retention of crossbar 18 in the hollow interior 32. Thus, as seen in FIG. 5, once crossbar 18 is inserted into the hollow interior 32 of body member 20, the slightest deviation of crossbar 18 away from a generally parallel orientation with the body member axis causes the ends thereof to engage one or more of the projections 50, 52, 54 thereby aiding in removal of the crossbar 18 from the needle as well as providing an abutment 40 engageable by the crossbar 18 to prevent the extrication thereof from hollow interior 32. While the projections 50, 52, 54 are shown as three in number extending radially from the apertured end wall 36 into the aperture 38, obviously a greater or lesser number of projections could be used, the projections could extend from the sidewall 30 instead of or as well as the end wall 36, and the projections could extend into the volume of hollow interior 32 aligned with the aperture 38 rather than directly into the aperture 38.

As shown in FIG. 2, a plurality of attachments 10 are integrally molded together in an assembly 68 strung along mounting rod 70 by means of necks 72. Thus, the crossbar 18 on each attachment 10 is secured to the rod 70 by means of a frangible neck 72 which can be readily severed during fastening of the attachment 10. This construction is particularly well suited for use with the aforementioned attaching "guns" inasmuch as a single actuation of the "gun" can readily sever neck 72 while passing the filament 16 and crossbar 18 through a tag and/or an object and into the interior 32 of hollow body member 20.

As also shown in FIG. 2, securing means in the form of a short, thin filamentary connector 72 secure facing surfaces of the flanges 60 of adjacent body members 20. The connector 74 is sufficiently long and thick to withstand a reasonable amount of tension or bending, but to break relatively readily when twisted. Such securing means 74 are interposed between and connected to the flanges 60 of adjacent body members 20 in order to avoid tangling of individual attachments 10 ss by having the filaments 16 intertwine with other filaments 16 in a given assembly 68 or in an adjacent assembly when a number of clips are packed or stored together. Reference may be made to U.S. patent application Ser. No. 256,890 by Gordon B. Lankton entitled "Assembly of Attachments and Method of Maintaining Same" (filed May 25, 1972 and assigned to the assignee of the instant application) for a detailed description of the use of such securing means. In general, the securing means are sufficiently strong to maintain the attachments 10 in proper orientation under normal conditions of storage and manipulation, but are readily frangible so that a given attachment, when used for is designated purpose, can be separated from the assembly 68 at the body member end while leaving the other attachments 10 well secured to one another. While the attachments 10 remain secured at both ends they tend to remain substantially parallel to one another; however, once a particular attachment 10 has been separated at the crossbar 18 it is quite possible for it to become entangled with other attachments 10 remaining in the clip. Accordingly, it has been found advantageous to use securing means which resist tension forces relatively strongly but resist torsion forces relatively weakly, so as to remain secured during manipulation of the attachment 10 but be readily separable thereafter merely by a twisting movement. The thin and short filamentary connection 74 has this characteristic as does a layer of relatively weak adhesive. The fastening of connectors 74 between body members 20 is not weakened during the heat sealing operation because the flanges 60 are located between the heat source and each connector 74 so as to protect the connectors from the heat.

The attachments are preferably molded of a thermoplastic material such as Nylon or polyurethane plastic. Preferably the material is axially stretchable like Nylon so that the filament loop may be enlarged during attachment of the device, in which case the filament may be molded thicker or with a variable thickness in anticipation of a reduction on stretching. In a typical embodiment the filament extends 6 inches in length and has a diameter of 0.020 inch, the crossbar is 0.280 inch in length and 0.045 inch in diameter, the body member interior is 0.38 inch in length and 0.300 inch in width, the aperture is 0.080 inch in width, each projection extends 0.015 inch into the aperture, and the flange is 0.420 inch in maximum length and 0.171 inch in maximum width. It should be noted, however, that these dimensions may be varied considerably, depending upon the particular attachment and its specific end use application.

The manner of use and functioning of the attachments described herein will now be apparent. The assembly 68 of FIG. 2 is inserted into an automatic tag attachment mechanism or "gun" of the type described in the aforementioned Bone U.S. Pat. No. 3,103,666 and the crossbars 18 are successively aligned with the hollow needle at its base. The needle is passed through an aperture in tag 12, then an aperture in object 14 (or through object 14 itself if no pre-existing aperture is found therein) and finally through aperture 38 of the body member 20 and into the hollow interior 12 thereof. As the attaching "gun" is actuated, the thus positioned attachment 10 is severed from the assembly 68 at its neck portion 72 and the crossbar 18 is forced through the needle and consequently through tag 12, object 14 and into interior 32 of body member 20 by a plunger, the filament 16 projecting laterally outwardly through the axial extending slot in the needle. As crossbar 18 moves past tag 12, object 14 and aperture 38, the filament 16 is pulled inwardly toward the needle and is bent substantially 90° onto the trailing portion of crossbar 18. As crossbar 18 leaves the needle, it tends to spring back to the T-configuration in relation to the filament 16. Crossbar 18, having thus moved from its closely parallel configuration relative to the aperture axis, will tend to engage abutment 40 and/or one or more of projections 50, 52, 54 during withdrawal of the needle and so will be retained in hollow interior 32 of body member 20. It should be noted that in view of the generally small dimensions of hollow interior 32, crossbar 18 may occasionally remain in the needle and therefore be withdrawn from interior 32 as the needle is withdrawn. In such an instance, projections 50, 52, 54 are particularly useful as means for aiding in the extrication of crossbar 18 from the needle as they engage even the slightest portion of crossbar 18 that extends from the needle, thereby exposing additional surface of crossbar 18 for engagement by abutment 40 and hence retention in interior 32. Likewise, a portion of one of the projections 50, 52, 54 may actually penetrate the axially extending slot in the needle, thereby engaging crossbar 18 therein and forcibly retaining it in interior 32 while the needle is withdrawn therefrom. The filament loop 22 which is thus formed by interlocking of the crossbar 18 within the body member 20 may be of any circumferential length, depending upon the initial length of the filament and its stretchability. The loop 22 thus formed functions to hold tag 12 and article 14 together, and even permits them to be hung as a unit by the loop 22. As crossbar 18 is now completely concealed within a unitary body member 20, the possibility of tempering or tag switching by manipulation of crossbar 18 is precluded.

By means of the construction of the present invention attachments may be manufactured with substantially greater facility and less expense than comparable attachments. The instant attachments further have the advantage of containing a unitary hollow body member having an opening therethrough adapted to receive the crossbar component of the attachment, thereby providing a self-contained, interlocking system having no exposed ends available for tampering or manipulation.

One embodiment of the present invention, having been shown and described in detail, various modifications and variations will now become readily apparent to those skilled in the art. Consequently the spirit and scope of this invention should be considered as defined not by the foregoing disclosure, but by the appended claims.

We claim:

1. An attachment device comprising
1. a filament,
2. a unitary hollow body member connected to said filament adjacent one end thereof, said body member comprising
   i. a sidewall defining a hollow interior for said body member,
   ii. an end wall having an aperture therethrough leading into said hollow interior, said hollow interior having a greater width than said aperture,
   iii. a sealed end wall opposed to said apertured end wall and connected thereto by said sidewall, and
   iv. a flange projecting ouwardly from said sidewall and configured and dimensioned to dispose an appreciable fraction of its mass and exposed surface area substantially outwardly of said sidewall, thereby to function as a heat sink and to permit heat sealing of said end wall without heat deformation of said apertured end wall and the portion of said sidewall adjacent thereto, and
3. a normally at least partially laterally oriented bar resiliently connected to said filament adjacent the other end thereof, said bar having
   i. a length greater than the maximum width of said aperture, and
   ii. a thickness such that when said bar is oriented in a direction generally parallel to said filament, said bar and said filament are passable axially through said aperture and receivable in said hollow interior; and when said bar within said hollow interior is oriented in a direction other than essentially parallel to the axis of said aperture, said bar is engageable by said apertured end wall to maintain said bar within said hollow interior, 2. The attachment device of claim 1 wherein said filament, said bar and said body member comprise a unitary piece of thermoplastic material.

3. The attachment device of claim 2 wherein said thermoplastic material is nylon.

4. The attachment device of claim 1 wherein said flange is disposed on said sidewall closer to said sealed end wall than to said apertured end wall.

5. The attachment device of claim 4 wherein said flange covers an entire peripheral section of said sidewall.

6. The attachment device of claim 4 wherein said flange projects outwardly from said sidewall to substantially varying levels.

7. The attachment device of claim 1 wherein said flange extends over an entire peripheral section of said sidewall.

8. The attachment device of claim 7 wherein said flange projects outwardly from said sidewall to substantially varying levels.

9. The attachment device of claim 1 wherein said flange projects outwardly from said sidewall to substantially varying levels.

10. The attachment device of claim 1 wherein said filament is connected to said body member by said flange.

11. The attachment device of claim 1 wherein said flange extends over an entire peripheral section of said sidewall closer to said sealed end wall than to said apertured end wall and projects outwardly from said sidewall to substantially varying levels and connects with said filament to said body member.

12. An assembly of a plurality of attachment devices, each of said attachment devices comprising
1. a filament,
2. a unitary hollow body member connected to said filament adjacent one end thereof, said body member comprising
   i. a sidewall defining a hollow interior for said body member,
   ii. an end wall having an aperture therethrough leading into said hollow interior, said hollow interior having a greatr width than said aperture,
   iii. a seald end wall opposed to said apertured end wall and connected thereto by said sidewall, and
   iv. a flange projecting outwardly from said sidewall and configured and dimensioned to dispose an appreciable fraction of its mass and exposed surface area substantially outwardly of said sidewall, thereby to function as a heat sink and to permit heat sealing of said end wall without deformation of said apertured end wall and the portion of said sidewall adjacent thereto, and
3. a normally at least partially laterally oriented bar resiliently connected to said filament adjacent the other end thereof, said bar having
   i. a length greater than the maximum width of said aperture, and
   ii. a thickness such that when said bar is oriented in a direction generally parallel to said filament, said bar and said filament are passable axially through said aperture and receivable in said hollow interior; and when said bar within said hollow interior is oriented in a directon other than essentially parallel to the axis of said aperture, said bar is engageable by said apertured end wall to maintain said bar within said hollow interior, said assembly further including securing means interposed between and connected to said flanges to secure said body members together.

13. An attachment device comprising
1. a filamentary member,
2. a hollow body member at one end of said filamentary member,
3. a head at another end of said filamentary member for insertion into said hollow body member, and
4. means formed on said body member for permitting the heat sealing of one end thereof without deformation of the other end thereof.

14. The attachment device of claim 13 wherein the heat sealing means comprises a flange.

15. The attachment device of claim 14 wherein said flange is disposed on said body member closer to the end to be sealed than to the other end thereof.

16. The attachment device of claim 14 wherein said flange covers an entire peripheral section of said body member.

17. The attachment device of claim 14 wherein said flange projects outwardly from said body member.

18. The attachment device of claim 14 wherein said filamentary member is connected to said body member by said flange.

* * * * *